US005538358A

United States Patent [19]

Scrimshaw

[11] Patent Number: 5,538,358

[45] Date of Patent: Jul. 23, 1996

[54] VEHICULAR ACCESS CONTROL DEVICE

[76] Inventor: Laird S. S. Scrimshaw, Site 1A, Box 9, R.R. #13, Alder Road, Thunder Bay, Ontario, Canada, P7B 5E4

[21] Appl. No.: 488,477

[22] Filed: Jun. 8, 1995

[51] Int. Cl.[6] ..... E01F 13/00

[52] U.S. Cl. ..... 404/6; 404/11; 49/49

[58] Field of Search ..... 404/6, 9, 11; 49/49; 256/1, 13.1

[56] References Cited

U.S. PATENT DOCUMENTS

| | | | |
|---|---|---|---|
| 1,563,637 | 12/1925 | Lundblad | 49/49 |
| 2,762,145 | 9/1956 | Rupe | 49/49 |
| 3,295,255 | 1/1967 | Russo | 49/49 |
| 4,097,170 | 6/1978 | Dickinson | 404/6 |
| 4,101,235 | 7/1978 | Nelson | 404/6 |
| 4,158,514 | 6/1979 | Dickinson | 404/6 |
| 4,318,079 | 3/1982 | Dickinson | 340/928 |
| 4,325,651 | 4/1982 | Dickinson | 404/6 |
| 4,367,975 | 1/1983 | Tyers | 404/6 |
| 4,918,740 | 12/1959 | Smith | 49/49 |
| 5,192,158 | 3/1993 | Bailey et al. | 404/11 |
| 5,288,164 | 2/1994 | Nasataka | 404/10 |

FOREIGN PATENT DOCUMENTS

| | | | |
|---|---|---|---|
| 2843426 | 4/1980 | Germany | 404/6 |

*Primary Examiner*—David J. Bagnell
*Assistant Examiner*—Pamela A. O'Connor
*Attorney, Agent, or Firm*—Edward M. Livingston

[57] ABSTRACT

A ramped barrier is provided to control movement of motorized vehicles into designated areas. The ramped barrier can be mounted on a road, parking lot, driveway or other surface. The barrier is provided with a series of parallel tines secured to a rotating shaft. The tines form a tire piercing barrier against unauthorized traffic. The shaft is housed within the barrier and adjacent to the top wall of the barrier. The tines, when retracted, extend from the shaft to about the outer edge of one ramped side of the barrier. The tines can be positioned to project upwardly against vehicular traffic in one or two directions.

7 Claims, 5 Drawing Sheets

VEHICULAR ACCESS CONTROL DEVICE

BACKGROUND

The present invention relates to controlling the travel of vehicular traffic along roads or other surfaces.

Other traffic control devices have been developed in an attempt to control vehicular traffic flow in a single direction. U.S. Pat. No. 1,563,637 to Lundblad, U.S. Pat. No. 2,762,145 to Rupe, U.S. Pat. No. 2,918,740 to Smith, U.S. Pat. U.S. Pat. No. 3,295,255 to Russo, U.S. Pat. No. 4,097,170 to Dickinson, U.S. Pat. No. 4,101,235 to Nelson, U.S. Pat. No. 4,158,514 to Dickinson, U.S. Pat. No. 4,318,079 to Dickinson, U.S. Pat. No. 4,325,651 to Dickinson, U.S. Pat. No. 4,367,975 to Tyers, U.S. Pat. No. 5,192,158 to Bailey et al., and U.S. Pat. No. 5,288,164 to Nasatka, relate to examples of traffic control devices intended to control traffic flow in a single direction by threatening destruction of vehicular tires if the vehicles attempt to breach the devices while traveling in the prohibited direction. Many of these devices must be installed below grade thereby requiring additional surface preparation and, in many cases, additional costs. Where the devices are adapted to prohibit traffic flow in two directions, travel in a second direction is usually prohibited by combining a gate or similar feature. Similarly, once those traffic control devices are installed, they cannot be readily removed for installation at alternate sites, if so desired.

The present invention may be readily adapted for installation to control access to private parking spaces and other controlled access locations. The device of the present invention is also readily adapted for easy removal and installation at an alternate location, where, for example, a private parking site is relocated. The ability to remove and reinstall the device is also useful in locations where severe winter weather conditions are encountered. The device may be temporarily relocated or removed to permit snow-plowing, removal of ice build up and the like. Periodic or seasonal removal or relocation may be particularly beneficial in certain circumstances. The present invention also provides vehicular traffic flow control in two directions where desired.

SUMMARY OF THE INVENTION

In one embodiment, the invention consists of a housing defined by a base, first and second ramps projecting upwardly and inwardly from the base. A top surface is provided intermediate of the two ramps. A rotatable shaft is mounted within the housing. A plurality of tines is secured to the shaft in parallel arrangement. The tines are adapted for rotation between first and second positions. The first ramp defines a plurality of channels for receiving corresponding tines when they are in the first position. A plurality of tines are adapted for lockable securement when they are in the second position. Each tine has a tapered section adapted to project from the housing in the second position.

In an other embodiment, the device of the present invention has a housing defined by a base and top surface and a ramp projecting upwardly and inwardly from the base to the top surface. A rotatable shaft is mounted within the housing, adjacent to the top surface. A plurality of tines are secured to the shaft in parallel arrangement. The tines are adapted for rotation between first and second positions o with at least one tine having a first section for lockable engagement with the housing when all of the tines are in the second position. Each tine has a second tapered section adapted to project from the housing when the tines are in the second position. In this embodiment, when the tines are in the first position, they define a second ramp positioned between the top surface and base.

In yet another embodiment, the device of the present invention has a housing defined by a base, first and second ramps projecting upwardly and inwardly from the base, and a top positioned between the ramps. A rotatable shaft is mounted adjacent to the top. A plurality of parallel tines are secured to the shaft and may be moved between first, second and third positions. The first ramp defines a plurality of channels for receiving corresponding tines when they are in the first position The tines lock by engaging with the housing in the second and third positions Each tine has a tapered section adapted to project from the housing when the tines are in the second and third positions.

In another embodiment, the housing is defined by a base, a first ramped section between the base and a top surface. A step like wall is provided on the side opposite the ramped section. A series of parallel tines are mounted on a rotatable shaft secured within the housing. The tines rotate between first and second positions, where in the second position, the tines project upwardly and outwardly from the device. When the tines are in the first position, they define a second ramped section permitting improved vehicular travel across the access control device.

In the device of the present invention, the tines may be of a length substantially equal to the length of the longest ramp section. Where it is desirable to do so, the tines may be somewhat longer than the ramp sections. It will be understood that the effective length of a tine will be greater than that of conventional blades designed to project upwardly from within the body of conventional barriers. In some conventional barriers, the blades had a maximum effective projected height limited by the height or the width of the barrier. In the device of the present invention, a tine which is considerably longer than the effective height of the device can be provided. In the device of the present invention, the effective vertical height of the barrier is the vertical distance between the tine end and the road surface. A longer tine will provide, among other things, a more visible and hence, a more intimidating barrier against vehicular travel.

Many of the conventional devices disclosed in the above referenced patents utilize sharp edged spikes or blades which may easily injure animals or pedestrians who accidentally contact those members. In the present invention, the projecting edges of the tines may be bevelled with gently rounded edges. In this embodiment, the ends are bevelled to provide an effective pointed end capable of penetrating a vehicle tire of a moving motor vehicle. However, the gently rounded edges are provided to avoid impaling pedestrians or animals which may accidentally contact the tines.

The access control device of the present invention may be readily adapted for use with electric powered motors and where desired, in combination with remote control devices for positioning the tines in the various operating positions. The use of a remote control feature may be provided to allow vehicle operators to personally operate the access control device without requiring the operator to exit the vehicle or open a window of the vehicle to access an external control mechanism.

The invention may be better understood with reference to the following written description and the appended drawings.

DETAILED DESCRIPTION

Figure 1:
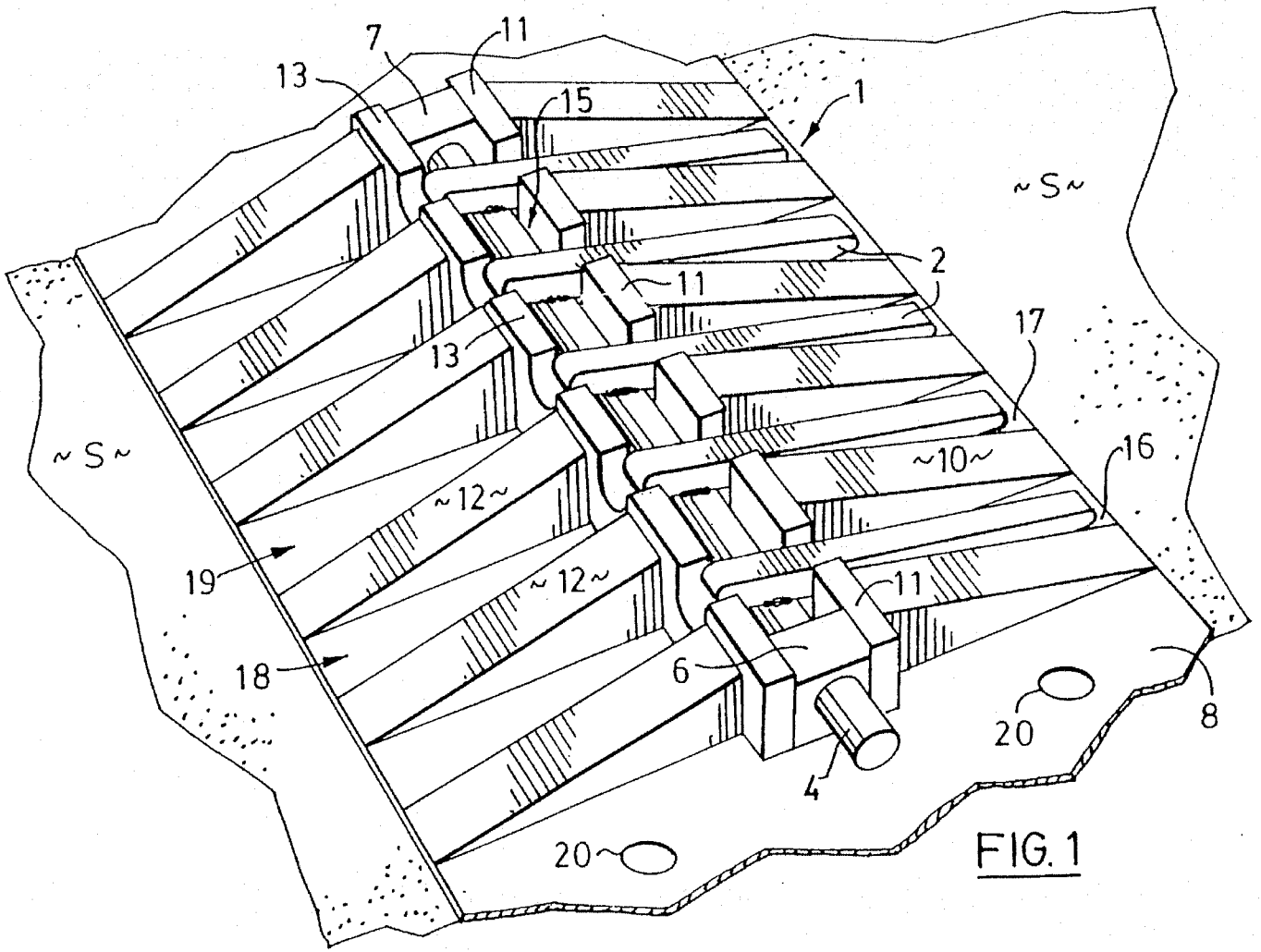
FIG. 1 is a perspective view of a partial section of one embodiment of the present invention.

With reference to FIG. 1, a partial section of an access control device 1 is shown in perspective. The preferred embodiment of the device as shown in FIG. 1 is mounted on a surface S. The device 1 has a number of tines 2 secured to a rotating shaft 4. The tines are secured to the shaft 4 with welds or other satisfactory means. The rotating shaft 4 is mounted in bearings 6 and 7. The base 8 supports a number of inclined ramp segments 10 to form a ramp section leading from the base 8 to the upper surface defined by top portions 11, 13. The ramp segments define a number of receiving channels 16 corresponding with the tines 2. The tines 2 nest within the channels 16 when the tines are fully retracted. The top portions 11, 13 define a channel 15 housing the rotating shaft 4.

A number of inclined ramp segments 12 define a second ramp connecting the base to the upper surface. The inclined ramp segments 12 define a series of channels 18. The bottom surfaces of the channels 16, 18 are sloped outwardly to corresponding terminal ends 17, 19. The sloping bottom surfaces enhance the outward flow of water and debris. This enables occasional cleaning of the device to avoid accumulation of debris or water within the device. The outward sloping bottom also minimizes the accumulation of water in locations exposed to temperature fluctuations which may create freezing and thawing cycles capable of preventing proper operation of the rotating shaft and tines.

The base 8 is also shown with bores 20 to receive bolts, screws or stakes to secure the device to the road surface S. It is understood that other means may be used to adequately secure the device in a desirable location. The securement means may be removable to permit relocation of the device, if desired.

By providing tines 2 which are substantially the length of the longest ramp section, it will be readily understood that the effective length of a tine will be greater than that of conventional blades designed to project upwardly from within the body of the barriers. However, in many instances, it will be preferable to provide tines of a length such that the nested tines will not extend beyond the outer edges of the receiving channels. The tines will be of a length which will allow them to fully nest in the receiving channels when the tines are in the first position. In those instances, the ramped and other load bearing surfaces of the device will bear the load of over passing vehicular traffic thereby relieving the tines, shaft and shaft bearings of any unnecessary load bearing function.

It will be readily understood by those in the art that the device will be constructed of sufficiently rigid construction materials capable of withstanding the load bearing and other forces which may be exerted on the structure during installation. In the preferred embodiment, corrosion resistant metal components are likely to be used. By way of example, the ramps 10, 12 may be of generally hollow construction if suitable steel or other metal material is used. Furthermore, although the drawings show only two bearings 6, 7, it may in some circumstances be necessary or advisable to provide additional bearings and support for the shaft and tines to withstand vehicular loadings and other forces. These and other design criteria will be applied to provide adequate service for a desired installation.

Figure 2:
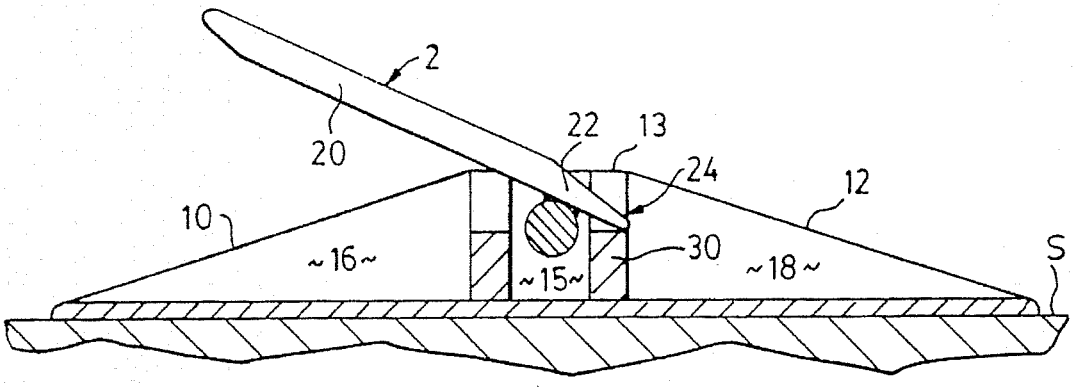
FIG. 2 is a cross sectional view of one embodiment of the present invention shown in FIG. 1 with the tines being positioned in an elevated position.
Figure 3:
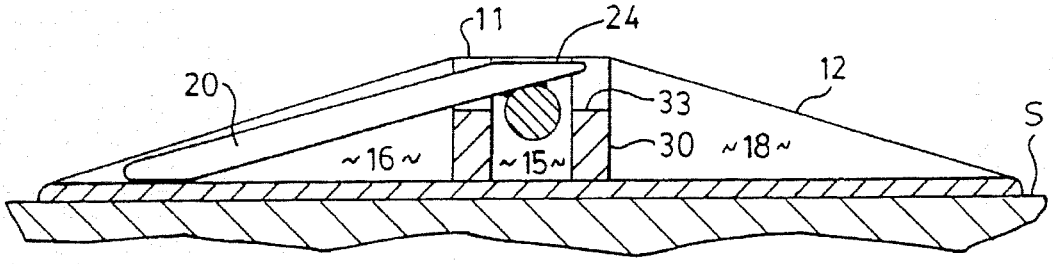
FIG. 3 is a cross sectional view of the embodiment shown in FIG. 1 with the tines being positioned in a lowered position.

In FIG. 2 and FIG. 3, the tine 2 is shown in both a projecting position (or second position) and in retracted position (or first position) such that the tine is nested in channel 16. The tine 2 has an elongated tapered section 20 which projects outwardly from the device when the shaft 4 is rotated to the second position. The distal end of the section 20 is bevelled with gently rounded edges. The distal end is bevelled to provide an effective pointed end capable of penetrating a vehicle tire of a moving motor vehicle. However, the gently rounded edges are provided to avoid impaling pedestrians or animals which may accidentally contact the tines.

The tine 2 has a second locking portion 22 of which terminal end 24 engages with surface 33 of abutment 30. With reference to FIGS. 2 and 3, the tine is secured against rotation in a clockwise direction when end 24 is engaged with abutment 30. It is possible to employ other means to adequately secure the tines against unwanted rotation or displacement when they are in the second position. Alternate means may be provided on the shaft to engage with the housing. Yet other means which will be readily apparent to those skilled in the art may be provided to achieve secure positioning of the tines.

When tine 2 is rotated to the first position, nesting within channel 16, terminal end 24 of the tine 2 is substantially flush with the surface defined by top portions 11, 13.

Figure 4:
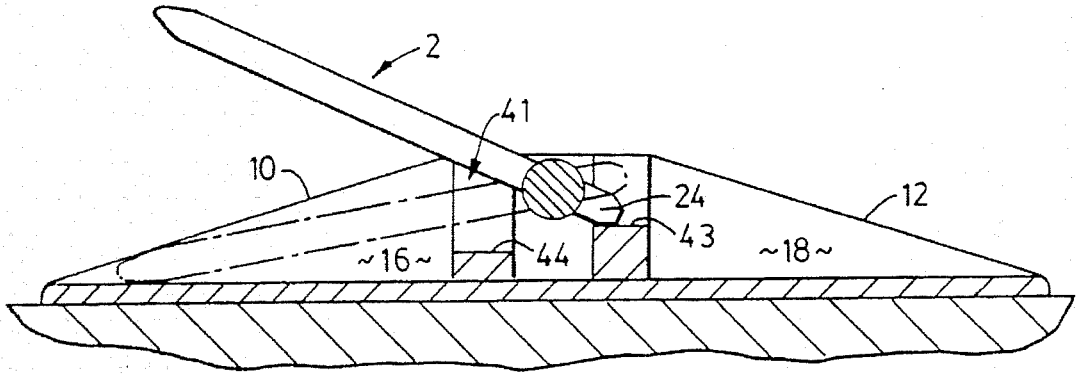
FIG. 4 is cross sectional view of another embodiment of the present invention showing the tines projecting in a first direction.
Figure 5:
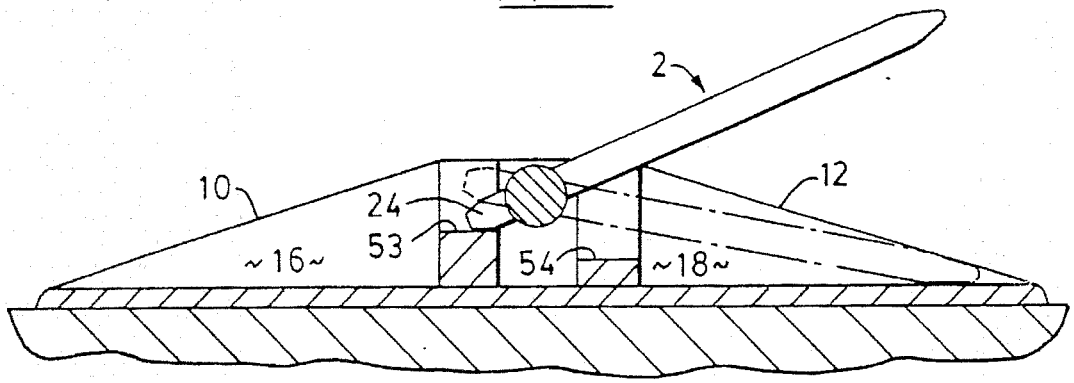
FIG. 5 is a cross sectional view of the embodiment of the present invention shown in FIG. 4 showing the tines projecting in a second direction.
Figure 6:
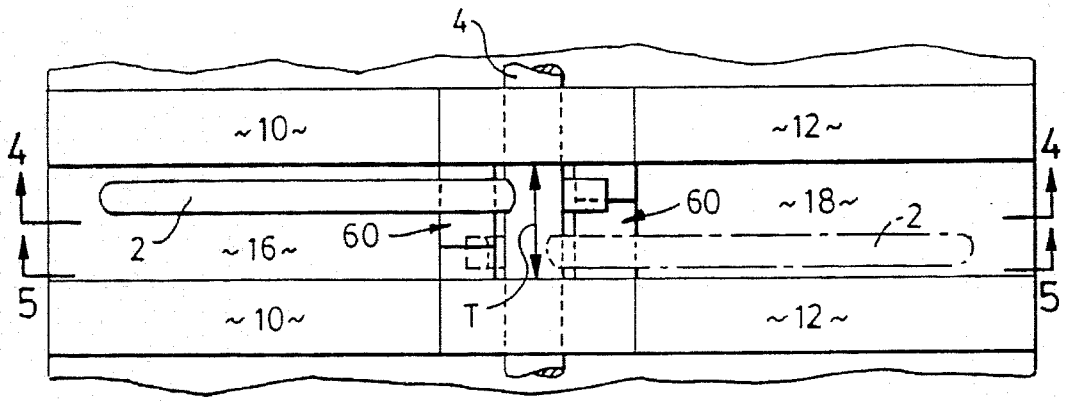
FIG. 6 is a plan view of the embodiment of this invention shown in FIG. 4 and FIG. 5, and in particular, showing section lines 4—4 and 5—5 corresponding to the cross sectional views in FIG. 4 and FIG. 5.

Another embodiment of the present invention is shown in FIGS. 4, 5, and 6. In this embodiment, the tines 2 are able to nest in either ramp sections of the device. FIGS. 4 and 5 are cross sectional views taken along sectional lines 4—4 and 5—5 shown in FIG. 6. In FIG. 4, the tine 2 is shown in the second position. In FIG. 5, the tine 2 is shown in a third position, pointing in a direction substantially opposite to the direction of the second position. In FIG. 4, locking end 24 of the tine 2 is engaged with abutment 43. The engagement between locking tine end 24 and abutment 43 secures the shaft against further clockwise rotation in the event of contact with a moving vehicle. Web 44 connects adjacent vertical members 41. The upper surfaces 11 of members 41 define the top of the device. The web 44 is of a height less than the height of abutment 43 to permit nesting of the tine within the corresponding channel. The tine is shown in a retracted position by representation of dashed lines.

In FIG. 5, the tine 2 is shown after rotation into a third position with terminal tine end 24 engaged with abutment 53. Web 54 is somewhat lower in height than abutment 53 to permit nesting of the tine within the corresponding channel when the tine is retracted. The tine is shown in the retracted position by representation of dashed lines.

FIG. 6 shows the embodiment of FIGS. 4 and 5 in plan view. The shaft is moved from the second to third positions, and vice versa, by a combination of rotational and translational movements. By way of example, movement from the second to third position can be carried out by disengaging the terminal end 24 from the abutment 43. The shaft is then partially displaced along its axis, along line T, until the terminal end is able to complete rotational movement of approximately 120 degrees. A channel 60 is defined between abutment 53 and web 44 and between abutment 43 and web 54. The channel 60 allows the tine portion 22 to rotate about 120 degrees while moving from its second to third positions (and from third to second positions). The shaft is then further displaced by translational movement along line T, in the same direction as before until terminal end 24 is engaged with abutment 53. Similarly, the tines and shaft may be moved from the third to the second position by retracing the steps referred to above in reverse order.

FIGS. 4 and 5 show an embodiment where the tines are secured in a somewhat different arrangement relative to the rotating shaft 4. The first and second portions 20, 22 of the tine 2 are secured so that the tine portions are positioned along an axis cutting through the center of the shaft. In the embodiment shown in FIGS. 1, 2 and 3, the tines are shown tangentially secured to the shaft.

Figure 4A:
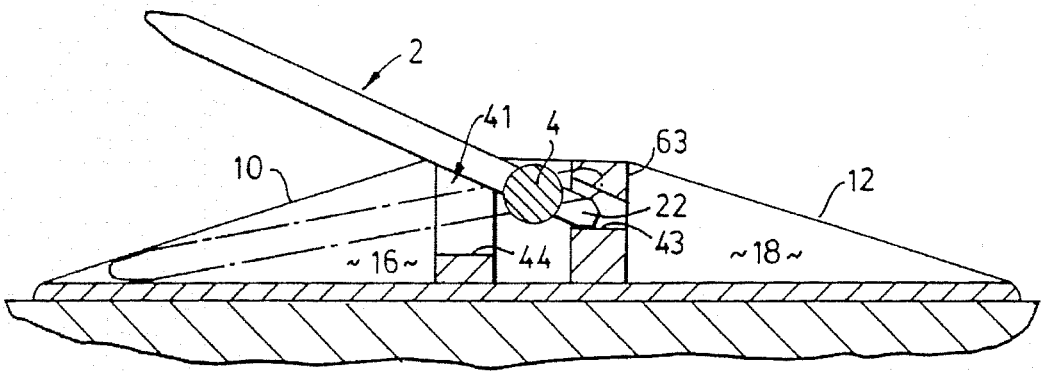
FIG. 4A is a cross sectional view of another embodiment of the present invention showing the tines projecting in a first direction.
Figure 5A:
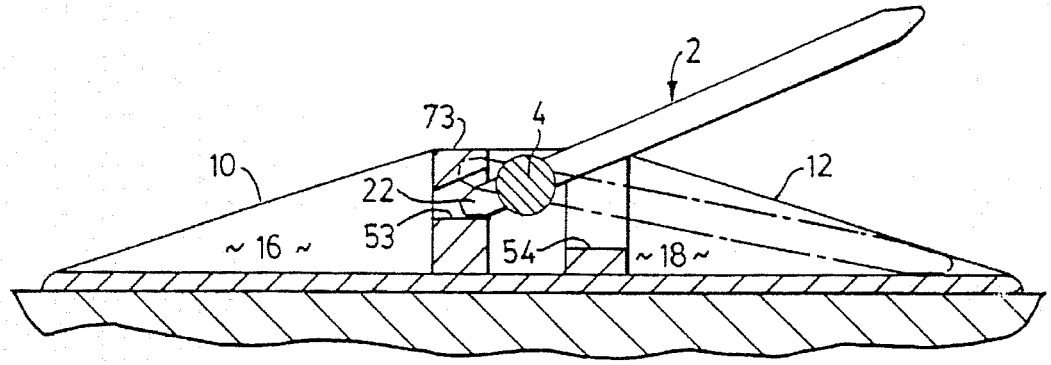
FIG. 5A is a cross sectional view of the embodiment of the present invention shown in FIG. 4A showing the tines projecting in a second direction.
Figure 6A:
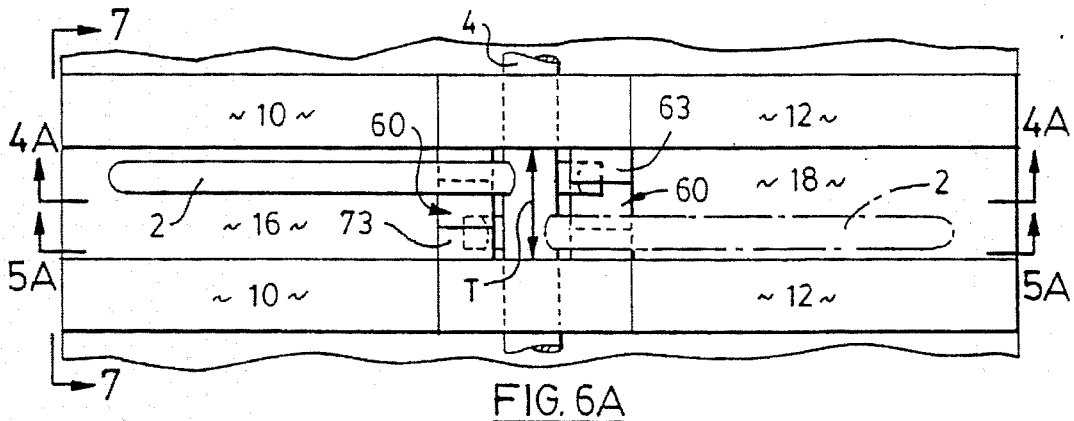
FIG. 6A is a plan view of the embodiment of this invention shown in FIG. 4A and FIG. 5A, and in particular, showing section lines 4A—4A and 5A—5A corresponding to the cross sectional views in FIG. 4A and FIG. 5A.
Figure 7:
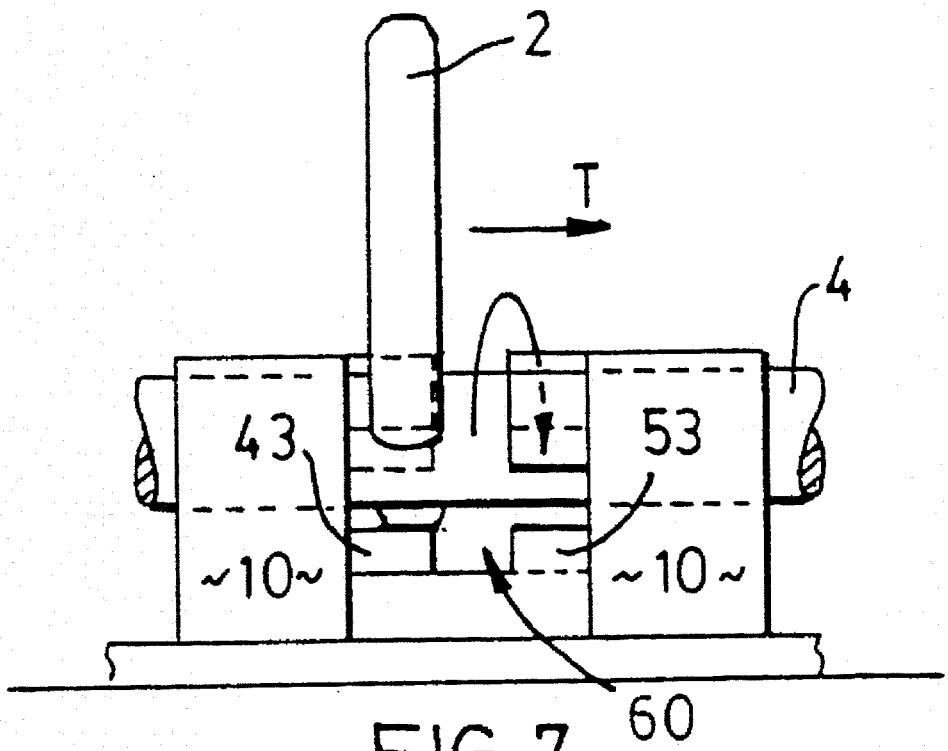
FIG. 7 is a frontal view of the embodiment shown in FIG. 6A showing the tines projecting in a first direction.
Figure 8:
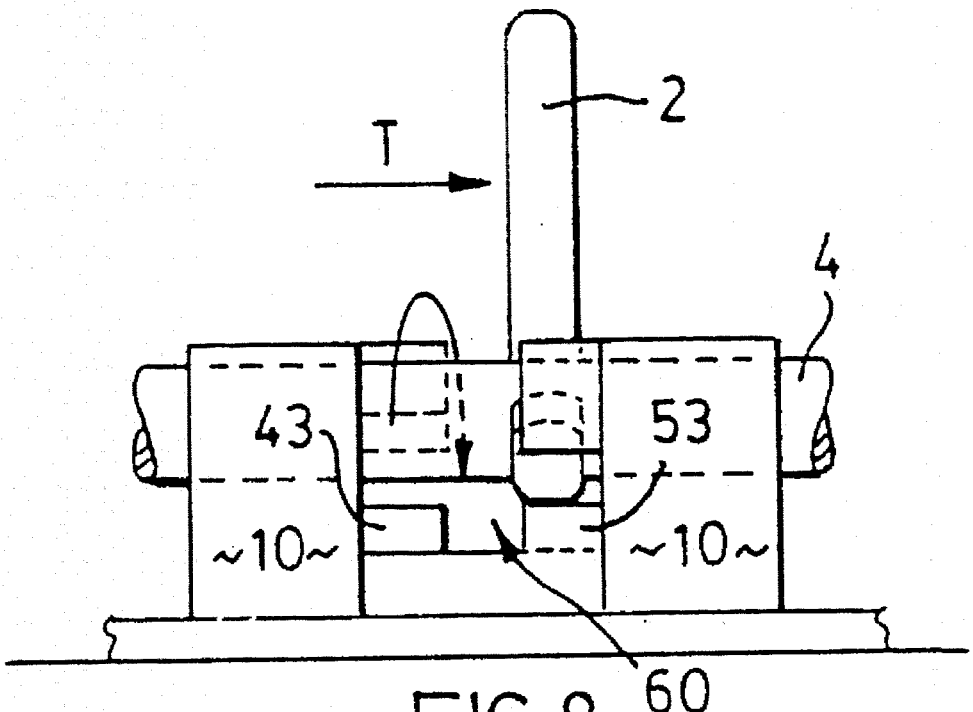
FIG. 8 is a frontal view of the embodiment shown in FIG. 6A showing the tines projecting in a second direction.

In a further embodiment of the present invention, a two way locking mechanism is provided. With reference to FIGS. 4A and 5A, secondary abutments 63 and 73 are provided to prevent downward rotation of the projecting tine portions when they are in the second and third positions respectively. Secondary portion 22 of the tine is locked in a second position when portion 22 is positioned in the recess formed between the abutment pairs 43, 63. Rotational movement of tine is prevented when the secondary portion is positioned in such recess. Tine 2 may be moved from the second position to the third position by first moving the shaft along its axis. The shaft is moved along line T until the secondary portion 22 of the tine is able to travel by rotational movement through the channel 60. When the portion 22 has been rotated through channel 60 into proper alignment with the recess, the shaft is translated further along its axis until portion 22 is engaged with the recess formed by abutment pairs 53, 73. When the translational movement is completed, the tine is locked in the third position and rotational movement of the shaft is prevented. Such a two way locking mechanism prevents either upward or downward deflection of the tines when they are engaged by a moving vehicle. The steps outlined above can be better understood with reference to FIGS. 7 and 8 which show the rotational and translational movements referred to above. Channel 60 is defined by raised abutments 43 and 53 as seen in FIGS. 7 and 8. The channel 60 is sufficiently wide to permit the secondary section 22 of the tine 2 to rotate about 120 degrees before further movement into the following position (i.e. from the second to the third position or vice versa.)

Figure 2A:
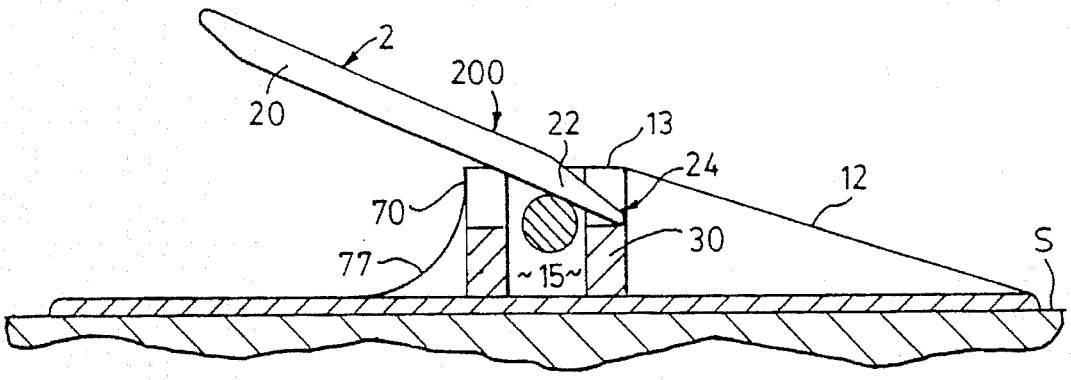
Figure 3A:
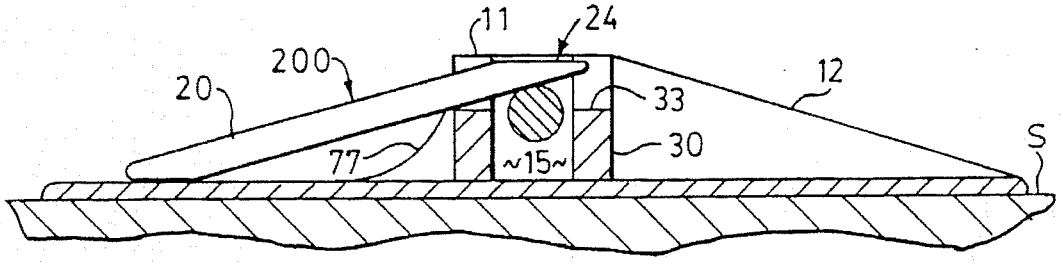

With reference to FIGS. 2A and 3A, a further embodiment is shown having only one ramped section defined by ramp portions 12 positioned on one side of the device. On the other side of the device, a step like drop is provided along wall 70. A web 77 may be provided to reinforce the wall against damage due to severe impact or other forces. The step like rise along wall 70 is readily apparent when the tines are in the second position as shown in FIG. 2A. However, when the tines are rotated into the first position as shown in FIG. 3A, the upper surfaces 200 of the tines define a ramp like riser connecting with the top of the device. When the tines are in the second position, the step like rise combined with the upwardly projecting tines may in many circumstances present an increased deterrent to unauthorized vehicular travel.

In view of the load bearing requirements for the tines of this embodiment, it will be understood that suitable reinforcements should be provided to ensure that the tines will support the expected weight of vehicles traversing the device.

Although specific embodiments have been described herein, it will be understood that many modifications and variations may be utilized without departing from the nature and scope of the present invention. Many other useful variations and embodiments will be identified by those skilled in the art as falling within the ambit of the present invention.

I claim:

1. A vehicular access control device comprising:

a housing having a base, first and second ramps projecting upwardly and inwardly from the base, and a top intermediate of the two ramps;

a rotatable shaft mounted within the housing and adjacent to the top of the housing;

a plurality of tines secured to the shaft in parallel arrangement, adapted for rotation between first, second and third positions;

the first ramp defining a plurality of channels for receiving corresponding tines in the first position;

the tines being adapted to be substantially contained within the corresponding channels when in the first position, the tines projecting in substantially opposite directions from the housing when the tines are in the second and third positions; and means adapted to secure the tines in the second and third positions.

2. A device as claimed in claim 1 wherein the tines are adapted to span substantially the width of the first ramp.

3. A device as claimed in claim 2, wherein the securing means comprise at least one tine adapted to lockably engage with the housing.

4. A device as claimed in claim 3, wherein the channels are downwardly and outwardly sloped toward the base.

5. A vehicular access control device comprising:

a housing having a base and top surface and a ramp projecting upwardly and inwardly from the base to the top surface;

a rotatable shaft mounted within the housing, adjacent to the top surface;

a plurality of tines secured to the shaft in parallel arrangement, adapted for rotation between first, second and third positions, each tine having a tapered section adapted to project from the housing in the second and third positions;

means adapted to secure the tines in the second and third positions;

the tines defining a second ramp between the top surface and base when the tines are in the first position.

6. A device as claimed in claim 5 wherein at least one of the tines is adapted for lockable engagement with the housing when in the second or third positions.

7. A vehicular access control device comprising:

a housing having a base, first and second ramps projecting upwardly and inwardly from the base, and a top positioned between the ramps;

a rotatable shaft mounted adjacent to the top;

a plurality of parallel tines secured to the shaft and adapted for rotation between first, second and third positions;

the first ramp defining a plurality of channels for receiving corresponding tines in the first position;

two or more of the tines being adapted for lockable engagement with the housing in the second and third positions, each tine having a tapered section adapted to project from the housing in the second and third positions.

* * * * *